US005242268A

United States Patent [19]

Fukazawa et al.

[11] Patent Number: 5,242,268

[45] Date of Patent: Sep. 7, 1993

[54] PUMP IMPELLER

[75] Inventors: Tetsuo Fukazawa; Kenkichi Kamata, both of Narashino; Shiro Ikuta, Tokyo, all of Japan

[73] Assignees: Pacific Machinery & Engineering Co., Ltd.; Calsonic Corporation, both of Tokyo, Japan

[21] Appl. No.: 862,322

[22] Filed: Apr. 2, 1992

[30] Foreign Application Priority Data

Apr. 30, 1991 [JP] Japan ..... 3-98941

[51] Int. Cl.[5] ..... F04D 29/22

[52] U.S. Cl. ..... 416/188; 416/223 B; 416/185

[58] Field of Search ..... 416/179, 182, 183, 185, 416/186 R, 188, 223 B

[56] References Cited

U.S. PATENT DOCUMENTS

| | | | |
|---|---|---|---|
| 1,111,250 | 9/1914 | Davidson | 416/188 |
| 3,442,220 | 5/1969 | Mottram et al. | 416/188 |
| 3,953,150 | 4/1976 | Onal | 416/183 |
| 4,389,160 | 6/1983 | Onal | 416/186 R |
| 4,981,417 | 1/1991 | Arbeus | 416/186 R |
| 5,108,257 | 4/1992 | Fukazawa et al. | 416/188 |

FOREIGN PATENT DOCUMENTS

| | | | |
|---|---|---|---|
| 6375 | 3/1968 | Japan | 416/186 R |

*Primary Examiner*—Edward K. Look
*Assistant Examiner*—James A. Larson
*Attorney, Agent, or Firm*—Kane, Dalsimer, Sullivan, Kurucz, Levy, Eisele and Richard

[57] ABSTRACT

An impeller in a water pump for circulation of cooling medium in a cooling system of an engine has a shroud with a shroud end to which the edges of the blade inlets are attached and which is formed in the cylindrical configuration substantially parallel to the rotary shaft. Each of the edges of the blade inlets is shaped so that it is continuously smooth from a shroud end surface at the inlet side thereof and extends upstream in the axial direction, while each of the edges of the blade inlets at the side of a casing extends substantially perpendicularly to the rotary shaft. The edge of the blade inlet attached to the cylindrical shroud end and the edge of the blade inlet at the casing side being connected therebetween by a smooth arc-like curve projecting convexly upstream. The inlet angle of the blade is set to substantially 0° at the inlet edge at the shroud end and to an angle calculated substantially on the basis of the conventional design at the inlet edge at the casing side. The impeller has the blades each formed by connecting the blade inlet to a blade outlet by a smooth curved surface.

4 Claims, 9 Drawing Sheets

PUMP IMPELLER

FIELD OF THE INVENTION

The present invention relates to an impeller in a water pump for circulation of a cooling medium in a cooling system of an engine.

BACKGROUND OF THE INVENTION

FIGS. 12 and 13 show a conventional water pump and an impeller thereof used in a cooling system of an engine, respectively. The water pump is mounted on a wall 2 at the side of an engine block having a suction opening 1. The water pump includes a pump housing 4 having a volute casing 3, and a rotary shaft 5 rotatably supported in a cylindrical projection of the pump housing 4. An impeller 10 made of steel plate having a boss 10*a* and blades 10*b* is firmly mounted on one end of the rotary shaft 5 within the pump housing 4, and a mechanical seal 8 is mounted between the pump housing 4 and the rotary shaft 5 adjacent to the impeller 10. A flange 9 for mounting a pulley (not shown) is firmly mounted on the other end of the rotary shaft 5, to which a torque is transmitted from a crank shaft of the engine.

In this conventional water pump, known as a centrifugal type pump, the impeller is designed on the basis of the conventional design. In recent years, impellers made of steel plate as shown in FIGS. 12 and 13 or impellers made of plastic by injection moulding have been used with the view of reducing the manufacturing cost. Each of these impellers has thinner blades and therefore a wider passage at each of the blade inlets. Water pumps with such impellers are used at higher temperatures and with faster revolutions because they have superior anti-cavitation characteristics and have a longer service life as compared with the water pumps having conventional centrifugal impellers of cast iron. However, the water pumps with these new impellers have the disadvantages of greater noise and lower pump efficiency. Moreover, it is difficult to further improve their anti-cavitation characteristic due to an increase in circulation flow within the impeller.

Additionally, recently, with an increase in the output power of the engine, the quantity of heat radiating from the engine to the cooling water has been higher. In order to cope with this problem without effecting an increase in the cooling ability by increasing the size of the radiator or the cooling fan and so on, there is a demand for water pumps with a better cavitation characteristic. Furthermore, since the engine room is overcrowded by various equipment, it has been attempted to make the engine more compact, having a pump in any arbitrary position. This design also requires a water pump with a better anti-cavitation characteristics. In addition, since improvement of fuel consumption has also been required from the view of preventing air pollution, a water pump which is smaller in size, weight and higher in efficiency is also desirable. However, it would be impossible to effect larger improvements in pumps of conventional design because of the conventional design techniques. The operational point of a conventional water pump lies in the pump specific speed of 300 to 400 (m.rpm.$M^3$/min), which is the point at which the best pump characteristic is provided. This operational point makes the improvement of the impeller in the water pump difficult.

SUMMARY OF THE INVENTION

It is an object of the present invention to provide the design technique of the impeller which greatly improves the anti-cavitation characteristics and pump efficiency, and to thereby sharply improve the characteristics of the engine cooling system.

In order to achieve the above-mentioned object, there is provided an impeller in a water pump for use in an engine cooling system, comprising a boss mounted on a rotary shaft, said boss having a shroud which stretches integrally therewith and has a meridian configuration defined by a concave arc-like surface of revolution, and a plurality of blades, each having a blade inlet and a blade outlet. The shroud has a shroud end to which the edges of the blade inlets are attached and which is formed in a cylindrical configuration substantially parallel to the rotary shaft. Each of the edges of the blade inlets are shaped so that they are continuously smooth from the surface of said shroud end at the inlet side thereof and extends upstream in the axial direction, while each of the edges of the blade inlets at the side of a casing extends substantially perpendicular to the rotary shaft. The edge of the blade inlet attached to the cylindrical shroud end and said edge of the blade inlet at the casing side is connected therebetween by a smooth arc-like curve projecting convexly upstream to thereby form the edge of the blade inlet. The inlet angle of said blade is set to substantially 0° at the blade inlet edge at the shroud end and to an angle calculated on the basis of the conventional design at the blade inlet edge at the casing side. The inlet angles of the blade are varied smoothly between the shroud end and the casing side to thereby form the blade inlet. Each of the blade inlets are connected to the end of the blade outlet by a smooth curved surface to thereby form the blade.

The above-mentioned object can also be achieved by forming the blade inlets and the blades on a flat plate-like shroud.

It is desirable for the reason to be stated below to form each of the blades, at the tip side thereof extending from the blade inlet to the blade outlet, in an arc-like configuration projecting convexly downstream.

In the specification, the term "the tip side of the blade" means the edge of the blade at the side of the casing extending from the edge of the blade inlet at the casing side to the edge of the blade outlet.

Now, the operation of the blades of the impeller in the water pump according to the present invention is explained as compared with the blades of the conventional design.

In the design of the blade inlets of the impeller in conventional turbo pump, the inlet angle of the blade is set and the edge of the blade inlet is formed with a view to make the meridian velocity of flow uniform in the entire edge of the blade inlet on the basis of a velocity triangle at the blade inlet. Accordingly, the smaller the diameter of the blade inlet is, the greater the angle of the blade inlet is designed. That is, the inlet angle at the boss portion, to which the blades are attached, is usually larger than the inlet angle of the blade at the outer diameter portion of the inlet. This the conventional design, is established as a technique for enhancing the pump efficiency and improving the cavitation characteristics with minimum loss at the inlet of the impeller. However, with such a design technique, the meridian inflow at the blade inlet is not uniform, the work of the blade at the boss side becomes weak and only about $\frac{2}{3}$ of the blade at the tip side works effectively. Nevertheless, since only the above-mentioned design technique has been established at present, the inlet angle of the blade is set widely on the basis of the velocity vectors.

The impeller in a water pump according to the invention resolves the above-mentioned problem and provides a design technique of the impeller which works effectively in the entire region of the blade. The operation of the impeller according to the invention is explained with reference to FIG. 11 in comparison with the conventional impeller. The inlet angle of the blade which is set according to the conventional design technique at the blade inlet with an outer diameter $r_{io}$ of the blade inlet and a diameter $r_{ib}$ of the boss, is shown by the dotted line in FIG. 11. The inlet angle of the blade becomes abruptly greater at the side of the boss diameter until it reaches 90° at the center of rotation. Meanwhile, the inlet angle of the blade of the impeller according to the invention is set at a diameter $r_{io}$ of the blade inlet in the same way as the conventional design technique, but is set at the side of the boss diameter to substantially 0° as shown by a solid line, which has a slope completely opposite to that of the inlet angle of the conventional blade. In the design of the conventional blade based on the inlet velocity vectors, the above-mentioned inlet angle of the present invention cannot be achieved. This worsens the cavitation characteristics of the conventional pump. In the present invention, when the blade inlet edge is shaped so that the blade inlet edge at the boss side extends upstream in the axial direction, while the inlet edge at the casing side is formed substantially perpendicular to the rotary shaft and the edges of the blade inlets at the boss side and the casing side are connected therebetween by a smooth arc-like curve projecting conversely upstream, it is possible to ensure the wider area of flow passage at the blade inlet, and to cut off the flow at the blade inlet in the vicinity of the boss or the root of the shroud to thereby introduce it effectively into the blade. This results in a uniform flow at the blade inlet, so that the impeller which operates at the entire region of the blade (from the boss side to the case side) can be provided, thereby improving the characteristic of cavitation and the pump characteristics. When the blade in the configuration of the inlet as stated above is combined with the shroud which form the concave arc-like surface of the revolution in the meridian section, the shroud permits a smooth change in the direction of the incoming water flow onto the shroud from the axial direction to the radial direction, so that the best characteristics of the pump can be obtained with a minimum loss within the impeller. In this case, for the arc forming the profile of the shroud, any curves may be used provided that they smoothly connect the boss and the shroud in the radial direction like a circle, an ellipse, a parabola and the like.

The configuration of the blade inlet according to the invention as stated above, makes it possible to ensure the wider area of passage at the blade inlet and realize the uniform inflow of water into the blade inlet, so that the meridian velocity of flow at the blade inlet diameter $r_{io}$ may be increased as compared with that in the conventional design. This makes it possible to design the blade inlet diameter $r_{io}$ smaller than the diameter of the conventional blade inlet in order to obtain the characteristic of flow rate-head equal to that of the conventional impeller. This is because, as illustrated in the structural drawing of the water pump according to the invention in FIG. 1, the smaller clearance between the casing and the blade functions as a seal which prevents the fluid under higher pressure at the outer periphery of the impeller from being circulated into the lower pressure portion. Since the smaller blade inlet diameter may be achieved as stated above, the blade according to the invention allows a seal to be formed, makes it possible to increase the volume efficiency of the pump and allow a sufficient rise in pressure within the impeller, so that the pump efficiency may be largely enhanced. As for the cavitation characteristic, in the conventional design it is worsened when the meridian velocity of flow at the blade inlet diameter $r_{io}$ is increased, but when the uniform inflow at the blade inlet has been realized according to the invention, the cavitation characteristics can be largely enhanced by making the tip peripheral velocity at the blade inlet lower than the meridian velocity of flow at the blade inlet of the impeller.

In the conventional impeller in the water pump, the blade inlet is only inclined slightly from the tip side of the blade to the shroud side as shown in FIGS. 12 and 13, and the diameters of the blade inlets at the tip side and the shroud side are not so varied therebetween. Judging from the specific speed in the above-mentioned pump design, that inclination is to be made larger, but such larger inclination requires that the inlet angle of the blade be set as described in FIG. 11. However, in practice, even if the inlet angle of the blade is set as stated above, it is impossible to realize an enhancement in the cavitation characteristics and pump efficiency, and, taking into consideration the rise in cost to the effects, the configuration of the blade inlet in the present states is more advantageous than that with greater inclination, so the diameters of the blade inlet at the tip side and the shroud side are not made so different therebetween.

DETAILED DESCRIPTION OF THE INVENTION

An embodiment of an impeller in a water pump according to the invention is hereafter explained in detail with reference to the drawings attached thereto.

Figure 1:
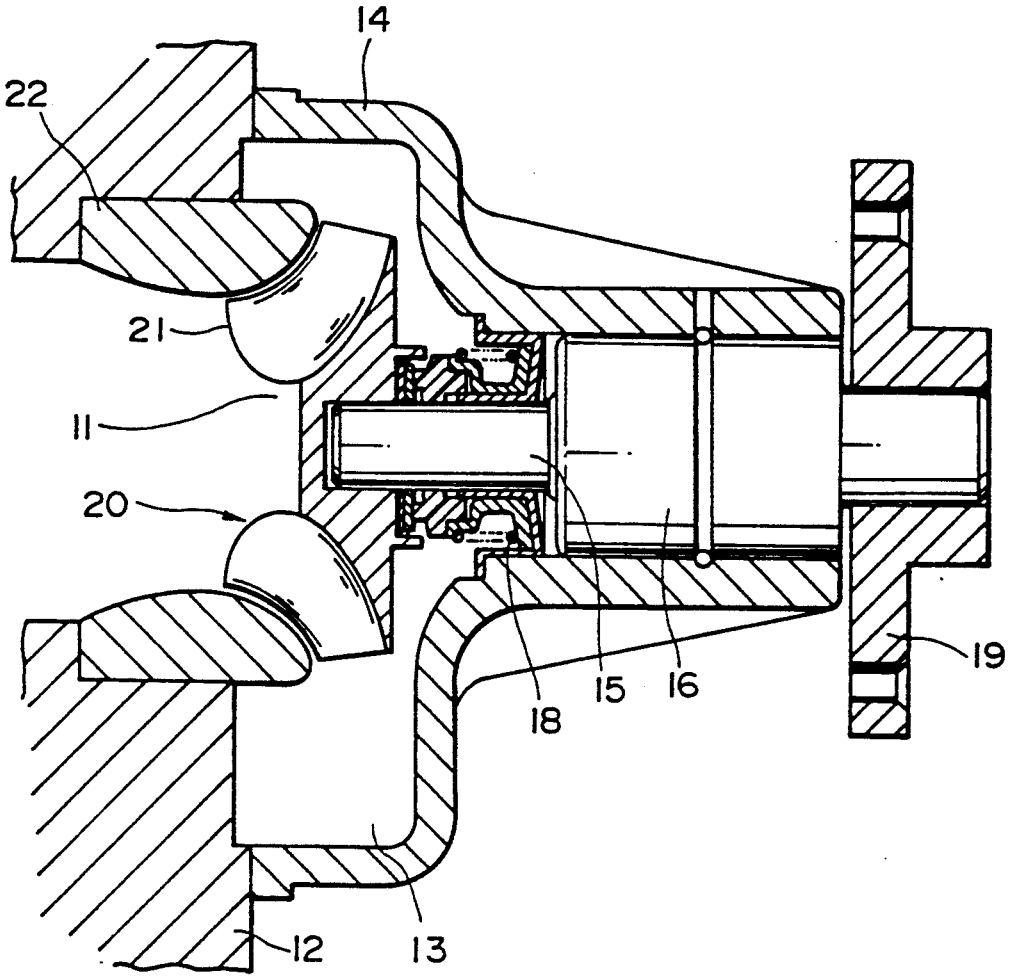
FIG. 1 is a longitudinal sectional view of a water pump according to the invention.

FIG. 1 illustrates a longitudinal sectional view of a water pump according to the invention used in the cooling system of an engine. In the drawings, like reference characters incremented by ten are used for the parts similar to those of the conventional water pump of FIG. 12. The water pump of the invention is different from the conventional water pump in the provision of an impeller 20 and a front casing 22 provided on the wall of an engine block to guide the flow of water into blade inlets 21 of the impeller 20.

The impeller 20 of the water pump according to the invention is explained with reference to FIGS. 2 and 3. FIG. 4 is a perspective view of the impeller in FIGS. 2 and 3.

Figure 2:
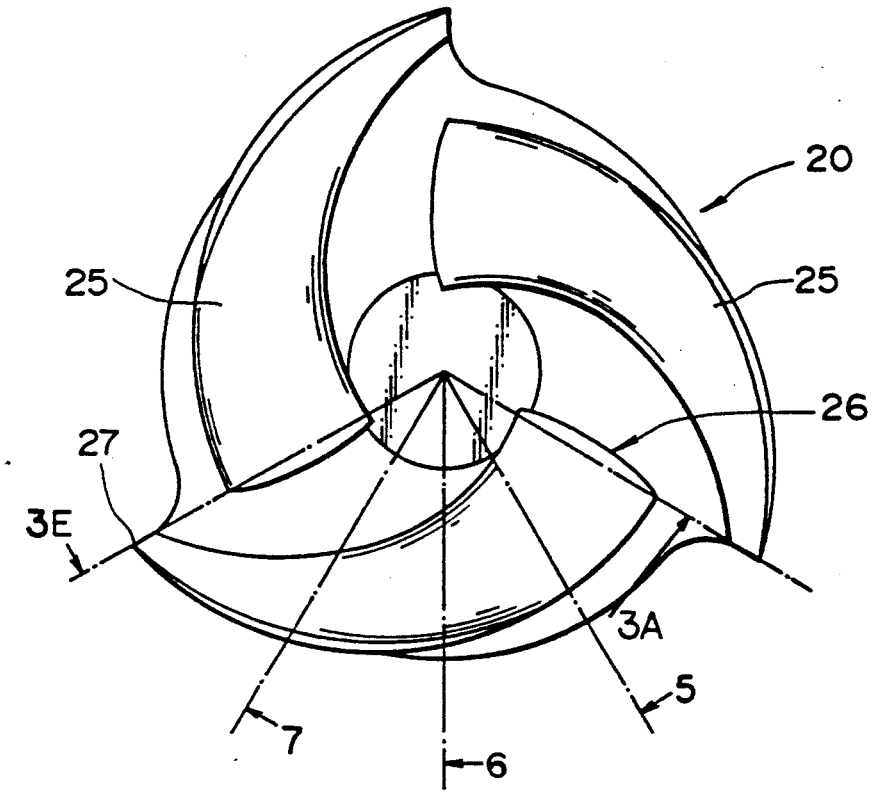
FIG. 2 is a front view of one embodiment of an impeller according to the invention incorporated in the water pump in FIG. 1.
Figure 3:
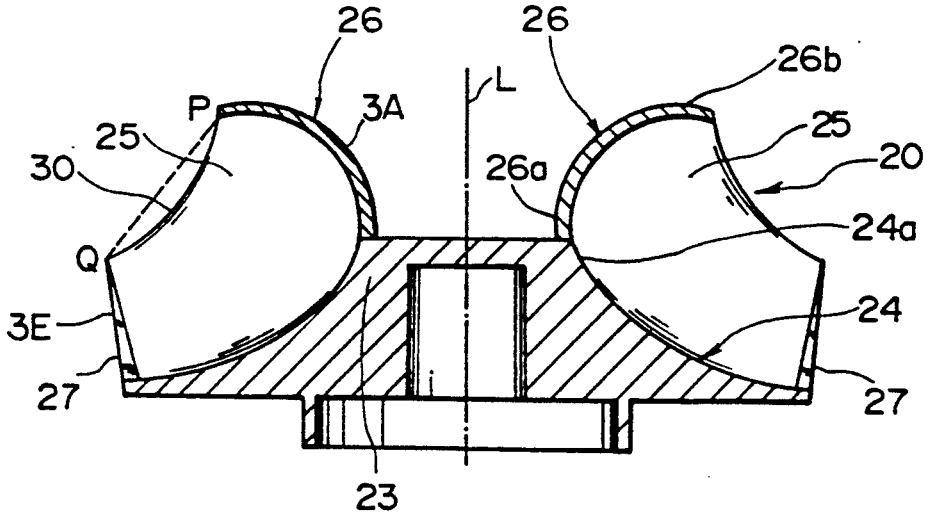
FIG. 3 is a meridian section view taken along the center axis of the impeller in FIG. 2.
Figure 4:
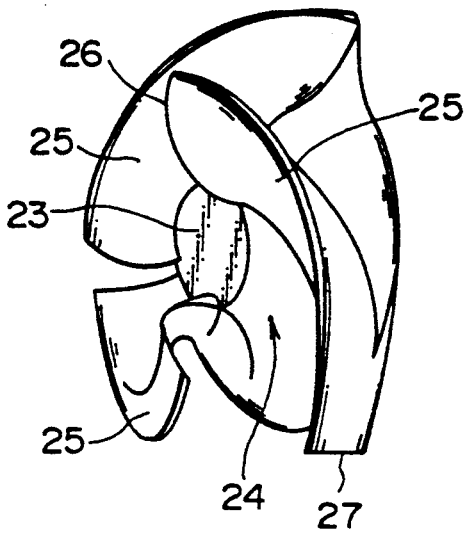
FIG. 4 is a perspective view of the impeller illustrated in FIGS. 2 and 3.
Figure 5:
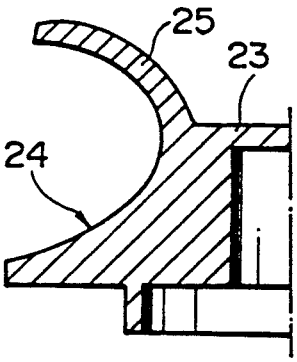
FIG. 5 is a cross-sectional of the blade taken along line B in FIG. 2.
Figure 6:
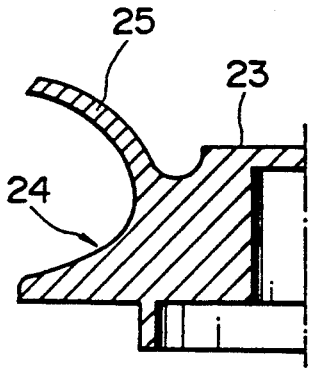
FIG. 6 is a cross-sectional of the blade taken along line C in FIG. 2.
Figure 7:
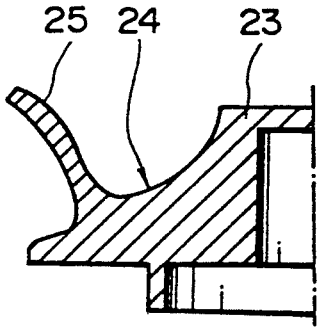
FIG. 7 is a cross-sectional of the blade taken along line D in FIG. 2.

FIG. 2 is a front view illustrating the shape of the impeller as viewed in the direction of a rotary shaft, and FIG. 3 is a meridian section taken along the center of revolution of the impeller. FIGS. 5, 6 and 7 are cross-sectional views of the impeller illustrating the configurations of the blade sections taken along the lines B, C and D from the blade inlet to the blade outlet of the impeller. The configurations of the blade sections as viewed in the direction of the arrow marks A and E are shown with the full lines A and E in FIG. 3, respectively.

Impeller 20 consists of a boss 23 mounted on a shaft 15 and defining a shroud 24 with a concave arc-like surface of revolution. Shroud 24 includes a shroud end 24*a*. Shroud end 24*a*, to which the blade inlet edge 26 is attached, is formed in a cylindrical configuration substantially parallel to the axis L of revolution, and the blade inlet edge 26*a* at the side of the shroud end is smoothly continuous to the surface the shroud end 24*a* at the inlet side, and extends upstream in the axial direction from the shroud end towards a diameter $r_{io}$ of the blade inlet, while the blade inlet edge 26*b* at the side of the casing is made perpendicular to the axis of revolution. Furthermore, the blade inlet edge 26 is formed by a smooth arc-like curve projecting convexly upstream which connects the blade inlet edge 26*a* at the side of the boss and the blade inlet edge 26*b* at the side of the casing. The inlet angle of the blade inlet edge 26 is substantially 0° at the blade inlet edge 26*a*, which is attached to the shroud end 24*a*, and is, at the casing side 26*b*, set to an angle calculated by the conventional design techniques. The inlet angle between the boss side and the casing side is varied smoothly as shown. Each of the blades 25 is formed by connecting the blade inlet 26 as stated above to a blade outlet end 27 with a smooth curve.

In general in impellers according to the conventional design having a plurality of blades, cavitation occurs if the blades are overlapped one above the other. However, in the present impeller, the length of the blade (from the blade inlet to the blade outlet) is contained within an angle obtained by dividing the entire periphery by the number of blades, as shown in FIG. 2, and the overlapping of the blades is substantially eliminated, and the cavitation characteristic is not worsened.

Figure 8:
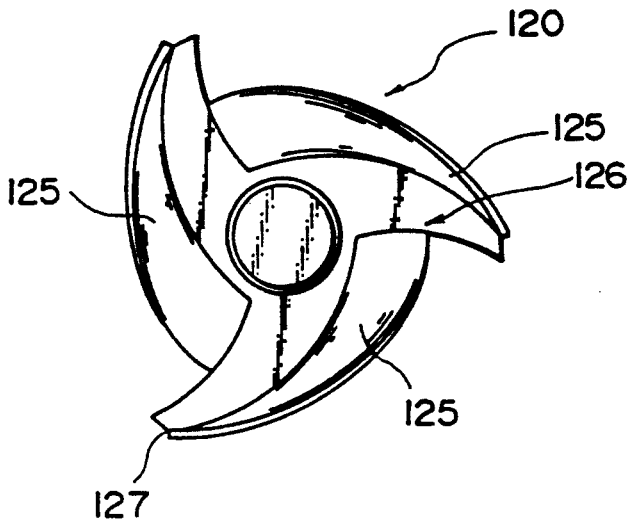
FIG. 8 is a front view of one embodiment of an impeller made by stamping of steel plates.
Figure 9:
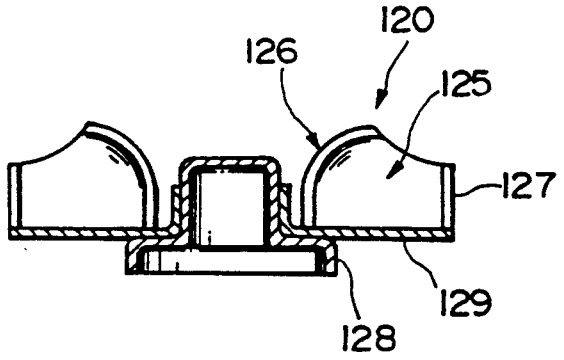
FIG. 9 is a longitudinal sectional view taken along the center axis of the impeller in FIG. 8.

The blades with the configuration of the blade inlet according to the invention can be formed on a simple disc-like shroud, to facilitate the production of the impeller by the stamping of steel plate, so that the cost of production can be reduced. FIGS. 8 and 9 show an embodiment of the construction of an impeller made of steel plate. Like reference characters incremented by 100 are affixed to parts similar to those in FIG. 3. This impeller 120 comprises two parts, a boss 128 to be mounted on a rotary shaft (not shown), and another part having blades 125 formed by stamping from a steel plate forming the flat disc-like shroud 129 and raising up them. The boss 128 and shroud 129 are joined by suitable conventional means.

Further, the profile at the tip side of the blades of the impeller according to the invention may be that of the straight line (PQ) connecting the blade inlet to the blade outlet as shown in FIG. 3, or an arc-like profile projecting downstream as shown in a full line in FIG. 3. The impeller with such a profile at the side of the blades also provides the characteristic of flow rate-head equivalent to that of the impeller with the blades formed by the straight line (PQ). This naturally reduces the torque for rotating the impeller, so that the pump efficiency may be enhanced. Further, as explained above about FIG. 1, the curved profile (like a bell) of the blade tip side from the inlet to the outlet allows a longer seal line, which increases the volume efficiency of the pump and therefore the pump efficiency.

Figure 10:
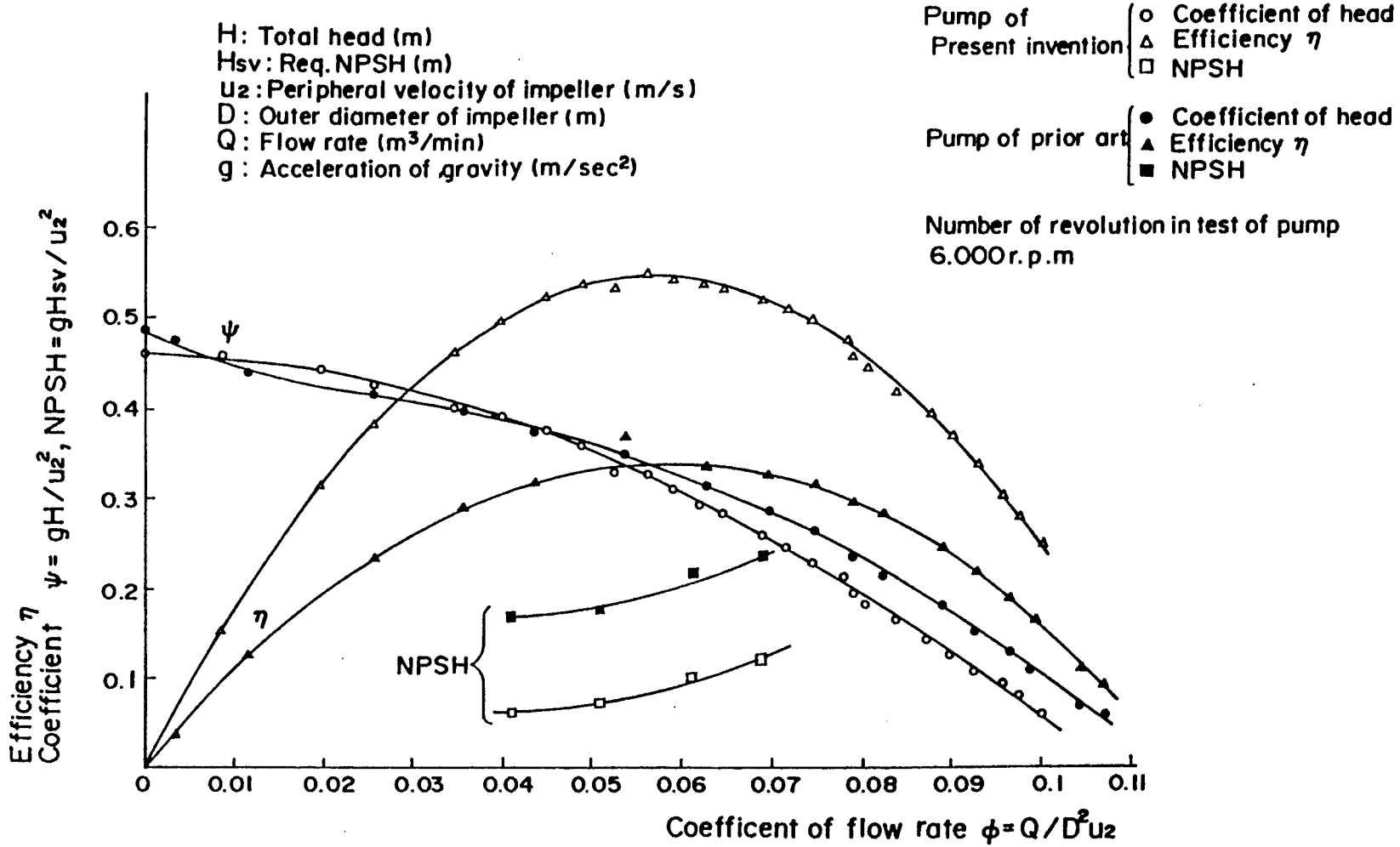
FIG. 10 is a graph illustrating the pump characteristics of both the water pump according to the invention shown in FIG. 1 and the conventional water pump in comparison.
Figure 12:
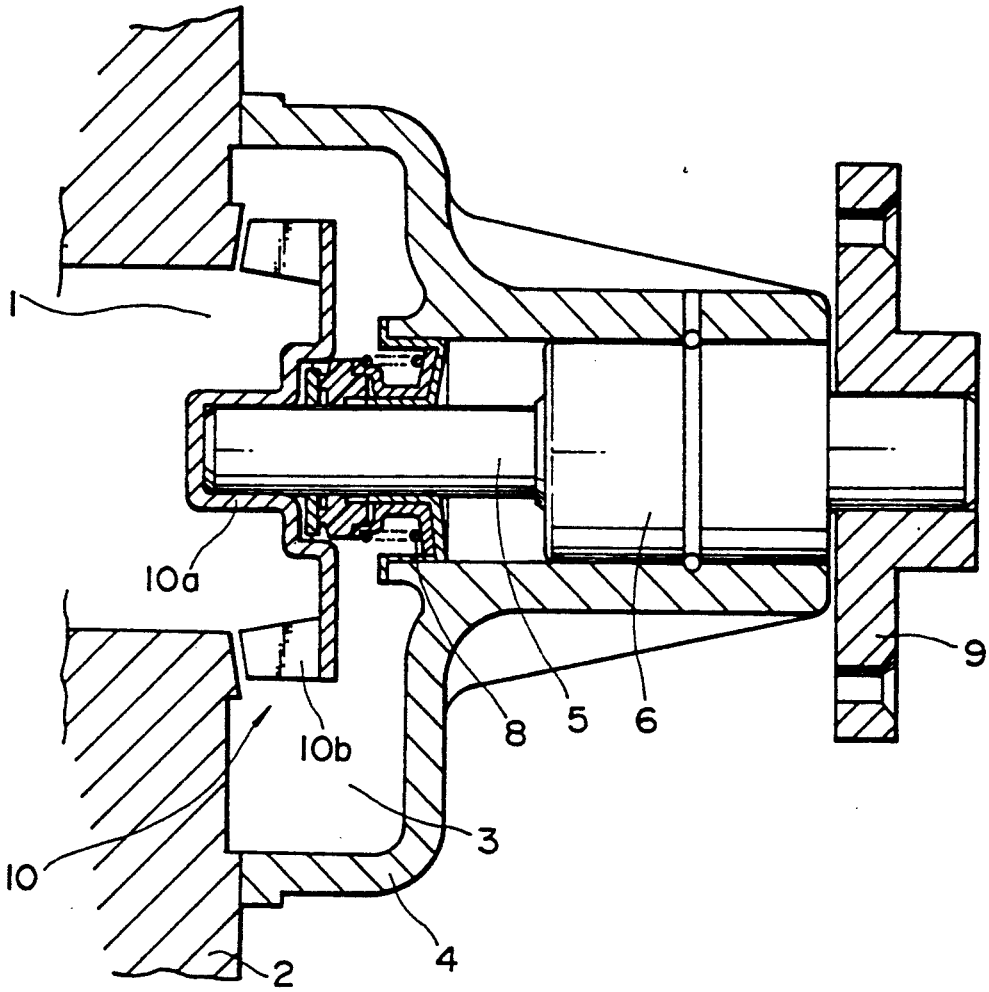
FIG. 12 PRIOR ART
FIG. 12 is a longitudinal view of a conventional water pump.
Figure 13:
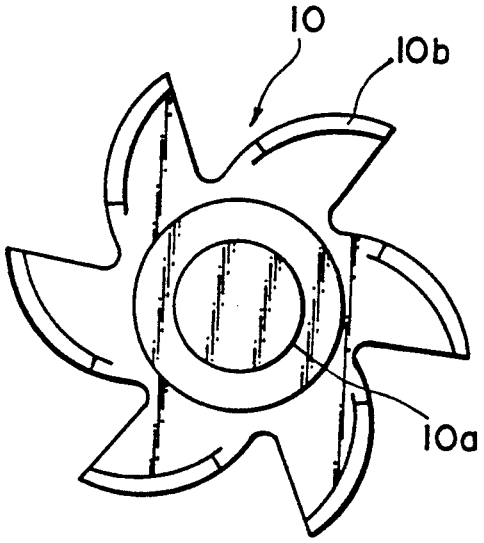
FIG. 13 PRIOR ART
FIG. 13 is a front view of the conventional impeller incorporated in the water pump in FIG. 12.

FIG. 10 illustrates both the pump characteristics and the cavitation characteristics (NPSH characteristics) of the water pump shown in FIG. 1 having the impeller according to the invention and the conventional water pump shown in FIG. 12 having the impeller in FIG. 13, comparing only the pumps. Both impellers measure 60 mm in the outer diameter and 13 mm in the outlet width, but regarding the inlet diameter, the conventional impeller measures 50 mm and the impeller of the invention 40 mm. Both pumps operated at 6,000 r.p.m. As evident from FIG. 10, there is no great difference in the characteristics of flow rate-head between the two pumps, but there is a large difference at requested NPSH in flow rates at the maximum efficiency, that is, 6.9 m in the conventional type and 2.9 m in the present invention. This illustrates that the cavitation characteristics of the water pump with the impeller according to the invention is greatly improved compared with that of the prior art. FIG. 10 further shows that the water pump according to the invention has increased the pump efficiency by approximately 20%. This illustrates that the water pump of the invention has remarkably less noise in the pump than that of the prior art.

Figure 11:
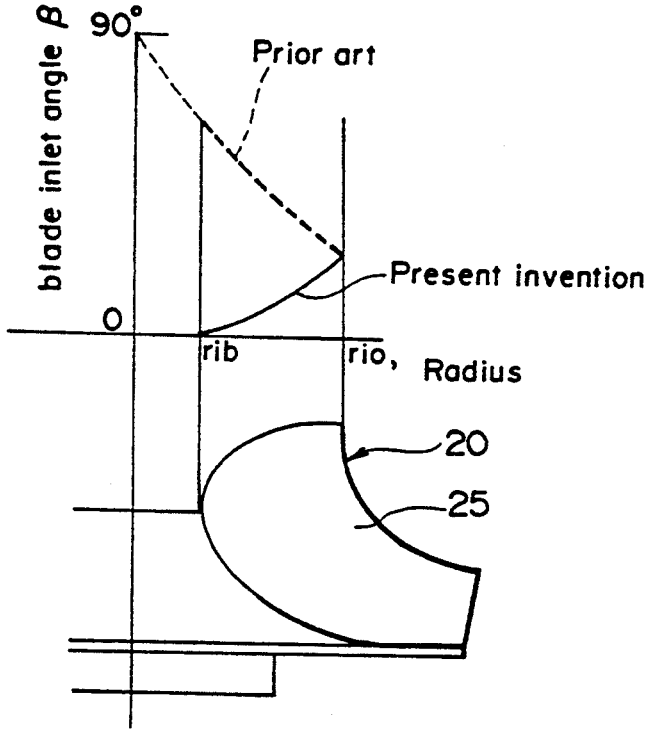
FIG. 11 is graph showing the blade inlet angle from the blade inlet edge at the boss side to the casing side.

The tests for obtaining the results of FIG. 11 were carried out with the water pump of the invention and that of the prior art placed in a motor vehicle. The test results showed that since the water pump is driven through a pulley and belt transmission from an engine, the conventional water pump does not supply the flow rate of the pump proportional to the number of revolutions of the engine to the engine cooling system because of cavitation. During actual running of the conventional water pump, particularly at a low gear speed with higher revolution of the engine, used on an upward slope, generating greater thermal load, the performance of the conventional pump is remarkably worsened due to cavitation. On the contrary, in the present water pump, the performance of the pump is not worsened by cavitation. Consequently, the design of the cooling system, does not require consideration if of the pump performance due to cavitation. This permits a big improvement of the cooling system such as the smaller sized radiator. Further, since the pump efficiency of the invention is better, the output of the engine is increased to an extent, thereby permitting the fuel consumption to be reduced. In addition, less noise of the pump according to the invention makes it possible to facilitate the sound absorption within the engine room.

The configurations of the blade inlets of the impeller are applicable for all kinds of fluid machinery, including pumps for general industries and not just for impellers for the water pumps as stated above.

What is claimed is:

1. A pump impeller comprising:

a boss mounted on a rotary shaft, said boss having a shroud and a plurality of blades, each having a blade inlet with an edge and a blade outlet said shroud having a shroud end to which the edges of the blade inlets are attached and which is formed in a cylindrical configuration substantially parallel to the rotary shaft, each of the edges of the blade inlets being shaped so that it is continuous smoothly from the surface of said shroud end at the inlet side thereof and extends upstream in the axial direction, while each of the edges of the blade inlets at the side of a casing extends substantially perpendicular to the rotary shaft, said edge of the blade inlet attached to the cylindrical boss shroud and said edge of the blade inlet at the casing side being connected therebetween by a smooth arc-like curve projecting convexly upstream to thereby form the edge of the blade inlet, and an inlet angle of said blade is set to substantially 0° at the blade inlet edge at the shroud end and increases continuously from the shroud end to the inlet edge at the casing, said inlet angle of the blade being varied smoothly between the shroud end side and the casing side to thereby form the blade inlet, and said blade inlet being connected to the end of the blade outlet by a smooth curved surface to thereby form the blade.

2. An impeller as set forth in claim 1, wherein the blade inlet at the casing side thereof is formed with a connection extending from the blade inlet to the blade outlet, in an arc-like configuration projecting convexly downstream.

3. An impeller as set forth in claim 1 wherein said shroud stretches integrally with said boss and has a meridian section defined by a concave arc-like surface of revolution.

4. A pump impeller comprising:

a boss mounted on a rotary shaft, said boss having a shroud and a plurality of blades, each having a blade inlet with an edge and a blade outlet, said shroud being formed in the shape of a flat plate, said plate having a plate surface, each of the edges of the blade inlets being shaped so that it rises at right angles to said plate surface from a position where the edge is in contact with said plate surface and extends upstream in the axial direction, while each of the edges of the blade inlets at the side of a casing extends substantially perpendicular to the rotary shaft, said edge of the blade inlet rising from said position on said plate surface and said edge of the blade inlet at the casing side being connected therebetween by a smooth arc-like curve projecting convexly upstream to thereby form the edge of the blade inlet, and an inlet angle of said blade is set to substantially 0° at the blade inlet edge at said position and increases continuously from said position to the inlet edge at the casing, said inlet angle of the blade being varied smoothly between said shroud side and said casing side to thereby form the blade inlet, and said blade inlet being connected to the end of the blade outlet by a smooth curved surface to thereby form the blade.

* * * * *